United States Patent [19]

Barr

[11] Patent Number: 4,836,794

[45] Date of Patent: Jun. 6, 1989

[54] EMI AND ENVIRONMENTALLY PROTECTED CONNECTOR CAP

[75] Inventor: John E. Barr, Brea, Calif.

[73] Assignee: Kern Engineering & Mfg. Corp., Fullerton, Calif.

[21] Appl. No.: 209,842

[22] Filed: Aug. 5, 1988

[51] Int. Cl.[4] ..... H01R 13/44

[52] U.S. Cl. ..... 439/135; 439/318

[58] Field of Search ..... 439/135, 148, 149, 150, 439/509, 314, 316, 607, 609, 315, 317, 318; 174/66; 138/89, 96 R

[56] References Cited

U.S. PATENT DOCUMENTS

| | | | |
|---|---|---|---|
| 3,258,731 | 6/1966 | Still et al. | 439/135 |
| 4,385,792 | 5/1983 | Baur et al. | 439/135 |
| 4,406,506 | 9/1983 | Baldwin | 439/135 |
| 4,445,743 | 5/1984 | Bakker | 439/314 |

*Primary Examiner*—Neil Abrams

*Assistant Examiner*—Khiem Nguyen

*Attorney, Agent, or Firm*—Poms, Smith, Lande & Rose

[57] ABSTRACT

An electromagnetic interference (EMI) and environmentally protected cap assembly for electrical connectors, for use when the mating connector is not in place, includes a hollow outer housing having a large diameter rear end and a smaller diameter front end having inwardly directed teeth for locking behind the outwardly extending lugs on the cylindrical form of the connector. An inner body member which is rotatable with respect to the housing, is spring biased by a plurality of wave washers toward the front of the outer housing. The inner housing has recesses which mate with the lugs on the connector to prevent relative rotation of these two parts, and detenting means are provided between the housing and the inner body member for locking the cap assembly onto the connector when the outer housing is assembled to the connector and rotated.

20 Claims, 3 Drawing Sheets

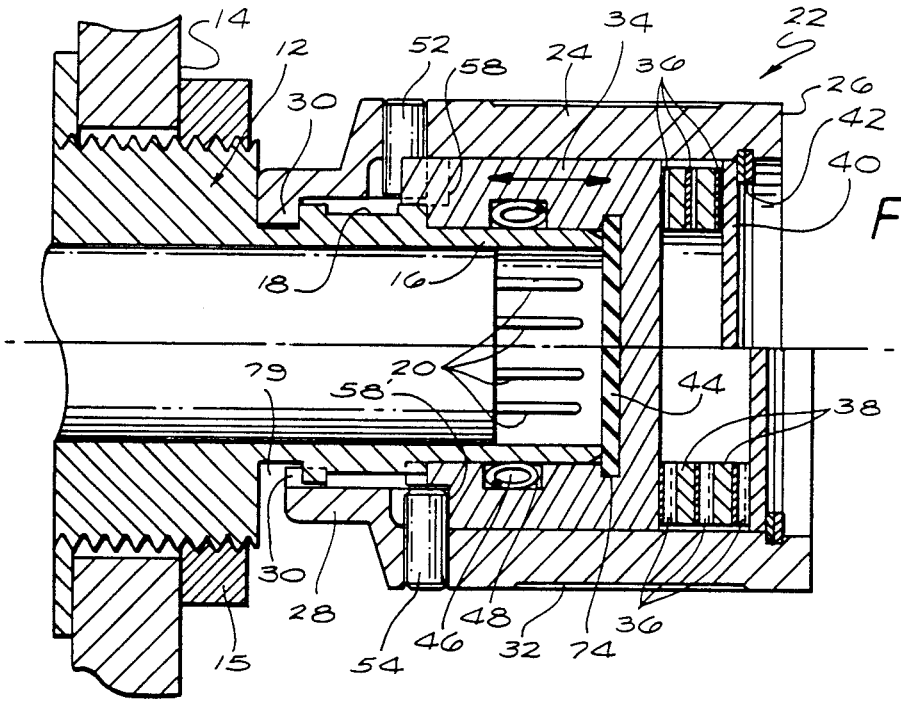
FIG. 1
FIG. 2
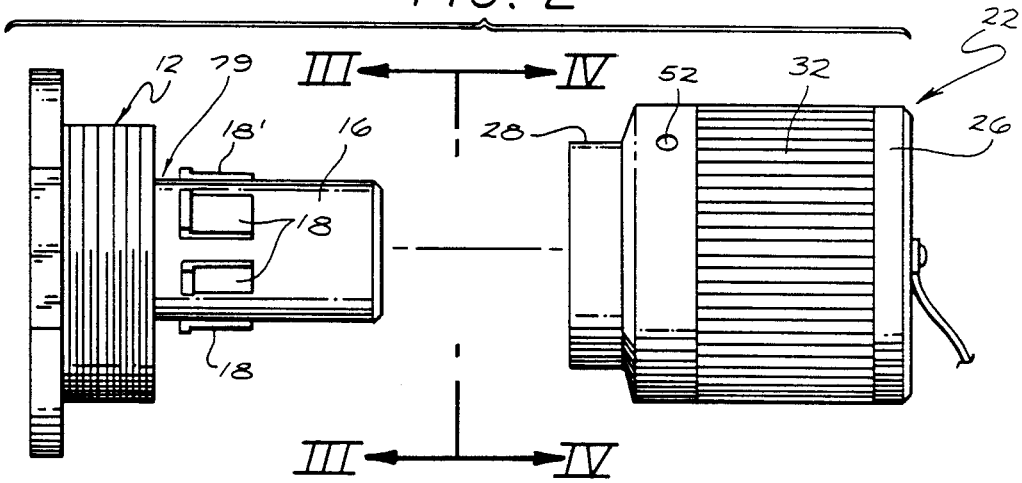
FIG. 3
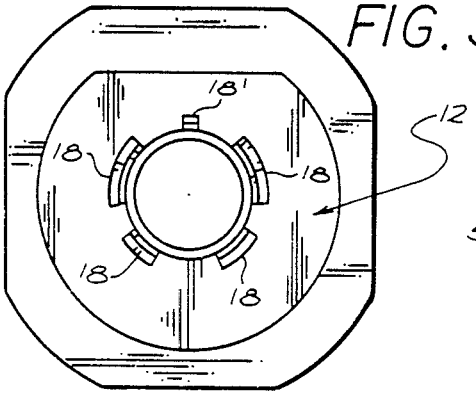
FIG. 4
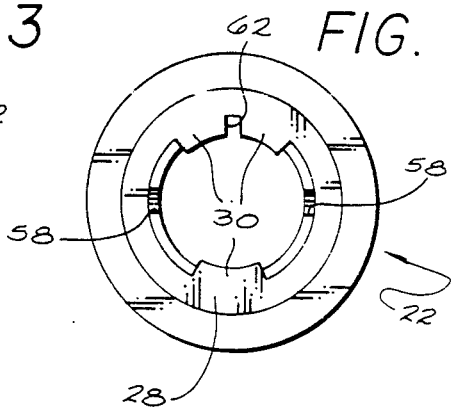

EMI AND ENVIRONMENTALLY PROTECTED CONNECTOR CAP

FIELD OF THE INVENTION

This invention relates to protective covers or caps for electrical receptacle connectors for use when the mating plug is not coupled to the receptacle, and which provide environmental protection against moisture, noxious vapors or the like, and which also provides protection relative to electromagnetic and radio frequency interference (EMI and RFI) as well as electromagnetic pulse (EMP).

BACKGROUND OF THE INVENTION

In order to protect electrical connectors to which the mating connector or plug has not been coupled, against environmental factors, and EMI, RFI and EMP, it has been proposed heretofore to provide protective covers to be secured to the unmated connector. However, the protective covers which have been proposed heretofore are relatively difficult to manufacture, and are not foolproof in operation or use.

Accordingly, principal objects of the present invention are to provide a simple electrical connector cap which will (1) positively seal the connector against EMI, RFI and EMP, (2) against moisture or other environmental factors, (3) which mechanically locks, in the protected position, against normal shock and vibration, and (4) is always ready for application, when in the unmated configuration.

SUMMARY OF THE INVENTION

In accordance with a specific illustrative embodiment of the present invention, an electrical connector or receptacle of the breech locking type, having an outwardly extending cylindrical surface and radially extending lugs to which a mating connector would normally be coupled, is provided with a cap having an outer hollow housing having a large diameter rear end, and a smaller front end, and an inner rotatable body mounted within the housing. The smaller diameter front end of the housing includes inwardly directed teeth which fit between the outwardly extending lugs on the connector, and then, when the housing is turned, the teeth lock behind the lugs. The inner body member has recesses which interfit with the protruding lugs on the connector, so that it remains fixed as the outer housing member rotates and locks the cap in place. The outer housing has inwardly directed pins secured to it, and these engage mating recesses in the inner body member to provide a spring detent action holding the cap in place, despite vibration. To the rear of the inner member is a flat sheet of resilient material such as silicone rubber or the like, which engages the inner end of the connector, and seals against the entry of moisture or potentially corrosive vapors. The rear of the outer housing is closed with a metal plate, and a spring lock washer. Between the rear plate and the inner body member, are a plurality of springy, wave-type washers spaced apart by one or more additional flat washers, to mechanically bias the inner member forward relative to the outer housing. The inner surface of the inner body member is provided with a groove into which an annular spiral spring is mounted, to provide EMI protection between the inner body member and the outward end of the connector.

In accordance with a broader aspect of the invention, a cap for an electrical connector is provided with detent means for locking the cap housing in its closed position following engagement by the teeth of the locking cap, behind the outwardly extending lugs on the connector body.

In accordance with a further feature of the invention, the inner body member may have at least two recesses for engaging each inwardly directed pin from the outer housing, so that there are two stable angular orientations between the inner body member and the rotatable outer housing, one in which the housing is locked to the connector, and one following release of the cap from the connector in which the inner body member is aligned with the outer housing in the proper position to receive the connector.

In accordance with another aspect of the invention, the inner body member may be provided with ramps upon which the pins ride as the outer housing is rotated, so that the inner housing is forced to the rear, compressing the wave washers, so that when the second set of recesses is reached, the inner body will shift into its detent position, with an audible click.

Other objects, features, and advantages of the invention will become apparent from a consideration of the following detailed description and from the accompanying drawings.

BRIEF DESCRIPTION OF THE DRAWINGS

FIG. 1 is a cross-sectional view of a connector cap and an associated breech locking electrical receptacle connector, illustrating the principles of the present invention;

FIG. 2 is a side view of an electrical connector and, to the right, an external view of a cap, with the two parts being ready for assembly;

FIGS. 3 and 4 are front views of the connector appearing to the left in FIG. 2, and of the mating cap, appearing to the right in FIG. 2, all as indicated by the arrows designated III and IV in FIG. 2;

DETAILED DESCRIPTION

Figure 5:
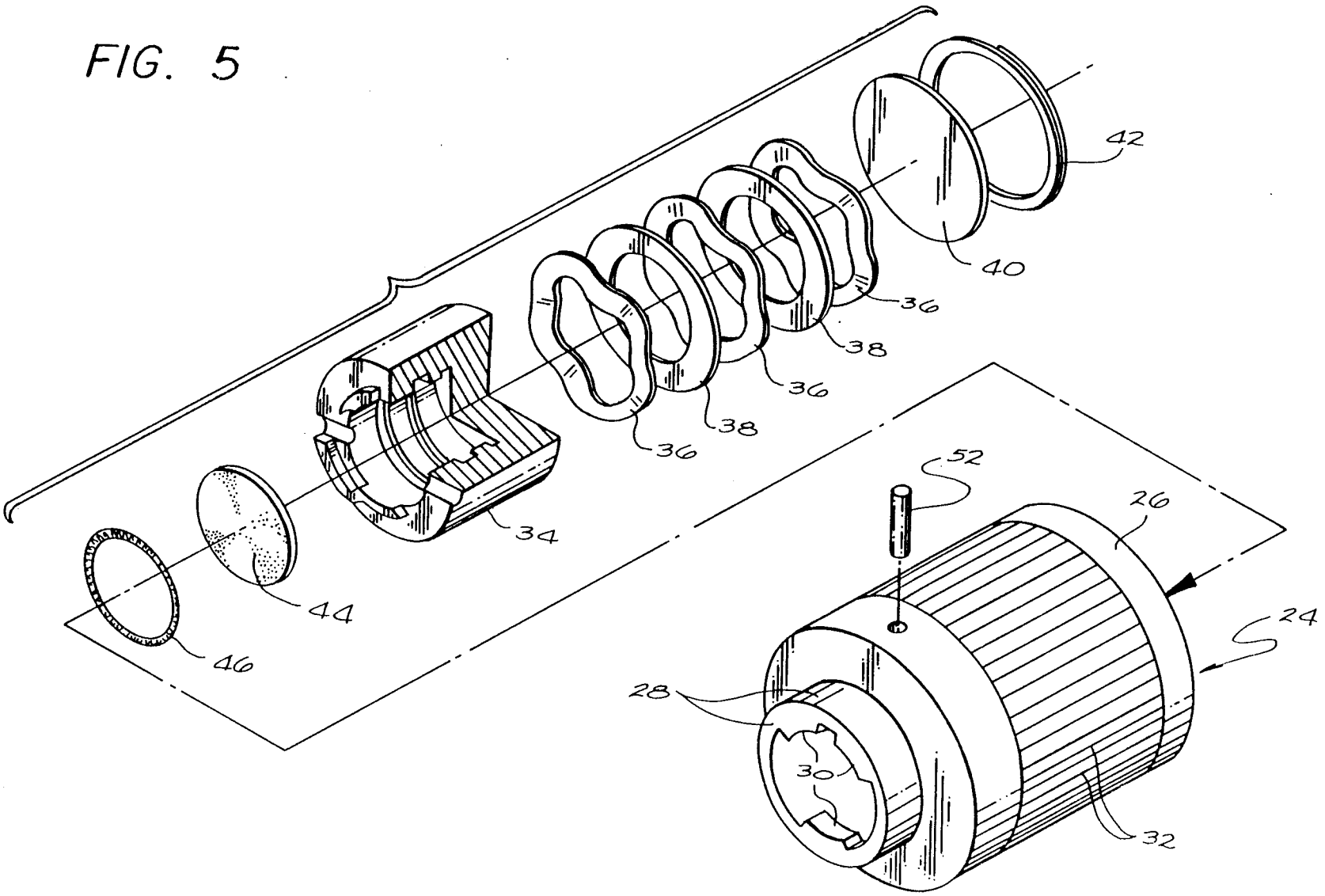
FIG. 5 is an exploded view of the EMI and environmentally protected cap illustrating the principles of the present invention.

Referring more particularly to the drawings, FIG. 1 shows an electrical receptacle connector 12 secured into the plate 14 by nut 15. Electrical connector 12 has an outwardly extending cylindrical portion 16 and includes a plurality of radially extending lugs 18 which are normally employed to orient and secure a mating electrical plug connector to the connector 12. However, as mentioned hereinabove, when no mating electrical connector is present, it is desirable to prevent the entry of moisture or other vapors into the electrical connector 12, and to prevent electromagnetic radiation or interference from entering or leaving the connector. Interference from electrostatic discharges (ESD) as well as EMI, RFI and EMP should also be prevented. Within the connector 12 there would normally be a plurality of conducting contacts (pin type shown) 20 which would be exposed, and available for coupling to the mating connector which is, of course, not present in FIG. 1.

The EMI and environmentally protected cap 22 as shown in FIG. 1 includes an outer housing portion 24, having a larger diameter rear end 26, and a reduced diameter front end 28 having inwardly directed teeth 30 which lock behind the radially outwardly extending lugs 18 of the connector 12. The outer surface of the housing 24 may have knurling or longitudinally extending ribs on its outer surface 32, for manual engagement. Within the housing 24 is an inner body member 34 which is mounted for relative rotation with respect to the outer housing member 24. The inner body member 34 is spring-biased to the left, as shown in FIG. 1, by the springy wave washers 36 which are spaced apart by the flat washer or washers 38.

To the right of the wave washers 36 as shown in FIG. 1 is the metal plate 40 which is secured in place by the locking spring retaining ring 42 which is a flat springy washer which includes nearly two full turns to complete its peripheral extent. A circular member 44, which may, for example, be made of silicone rubber, is located in a recess within the inner body member 34, to provide a moisture and vapor-proof seal at the inner lip of the cylindrical portion 16 of the electrical connector 12. Tolerances are such that the seal member is always engaged when the cover is mated with the receptacle.

An annular coil spring 46 is mounted within a recess 48 on the inner surface of the inner body member 34, to provide an electromagnetic radiation seal between the inner surface of the inner body member 34, and the outer surface of the cylindrical portion 16 of the electrical connector 12.

The outer housing 24 is provided with two inwardly directed pins 52 and 54 which may be directly opposite one another adjacent the smaller end 28 of the housing 24. The inner member 34 is spring-biased to the left, as shown in FIG. 1, by the wave washers 36. With each of the three wave washers 36 having a total compression of about 0.030 inch, the three washers together provide a travel of nearly one-tenth of an inch, in one embodiment. The inner body member 34 is provided with four recesses 58, with the pin 54 being shown seated in the recess 58′ at the lower showing of FIG. 1, while the pin 52 has not entered the recess 58 in the showing in the upper half of FIG. 1. With the two pairs of opposed recesses 5B, located 90 degrees from one another as shown in FIG. 6, for example, the resiliently biased inner member 34 serves to lock or detent the housing 22 in the locked position, or alternatively, in the fully open position, as the inner body member 34 is held in a fixed angular orientation with respect to the connector, (notch 66 interlocks with tooth 18′ on barrel 16 of receptacle 12) while the outer housing member 24 rotates with respect to both the electrical receptacle connector and the inner body member until the fully unlocked position is reached and detented.

FIG. 2 shows the connector 12 and the cap 22 spaced apart from one another and ready to be mated. Visible in FIG. 2 are the outwardly protruding lugs 18 on the cylindrical portion 16 of the connector, with the lugs 18 serving both to guide and to permit the locking engagement of connector 12 with either a mating plug connector or the cap 22.

FIG. 3 and FIG. 4 are views taken in the directions indicated by the Roman numerals III—III and IV—IV, respectively, of FIG. 2. Thus, FIGS. 3 and 4 show the mating configurations of the connector and the protective cap, respectively. In reviewing FIGS. 3 and 4, it may be noted that one of the outstanding lugs 18′ is substantially smaller in circumferential extent than the others, and matches a similar recess 62 between two of the inwardly directed teeth 30 which are shown in FIG. 4.

Figure 6:
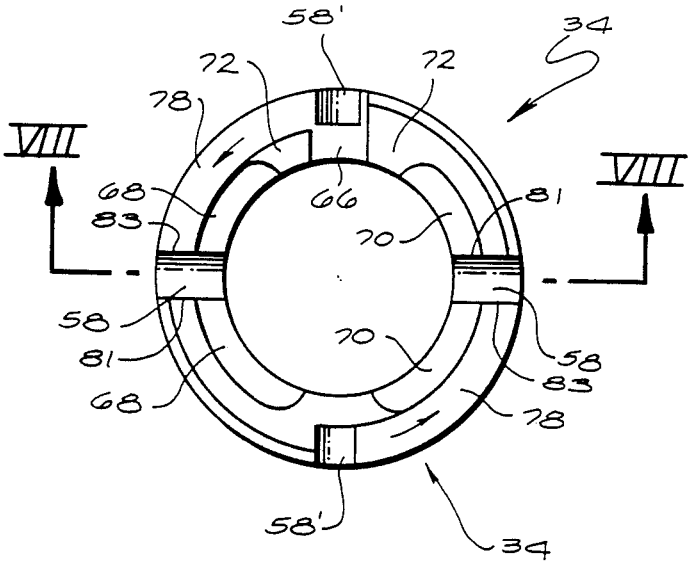
FIG. 6 is a top plan view of the inner body member forming a part of the cap.

Incidentally, as best shown in FIG. 6 of the drawings, the inner body member 34, has a series of recesses 66, 68 and 70 which are oriented to receive the outwardly directed lugs 18 from the connector 12, and to prevent the angular rotation of the inner body member 34 relative to the connector 12, while the outer housing 24 is being rotated to lock the teeth 30 behind the lugs 18. Incidentally, it may be noted that the recess 66, having raised portions 72 on each side of it, is aligned with the relatively small recess 62 between two teeth 30 of part 24, as shown in FIG. 4 and with the outwardly extending lug member 18′ of FIG. 3, when the connector and cap are disassembled, and ready for assembly. The recess 74 near the rear wall of the inner body member 34 which holds resilient sheet member 44, may be clearly seen in FIGS. 7 and 8 of the drawings.

Figure 7:
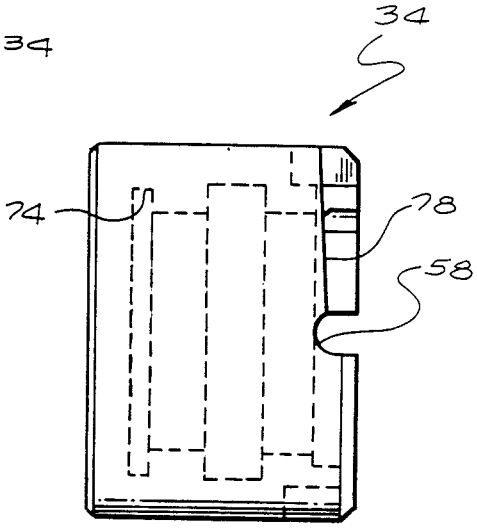
FIG. 7 is a side view of the inner body member of FIG. 6.
Figure 8:
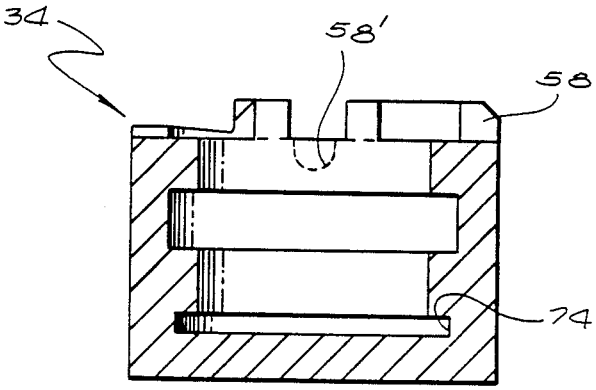
FIG. 8 is a cross-sectional view taken along lines VIII—VIII of FIG. 6.

Now, the function of certain ramps such as that shown at reference numeral 78 in FIGS. 6 and 7 of the drawings will be noted. Initially, as the cap is being mated to the connector, the two pins 52 and 54 are engaged with the two pairs of recesses 58′. By further pressing on housing 24 the teeth 30 align with the space 9 and disengage pins 52 and 54 with recesses 58′ of inner body 34 and compress springs 36. The two recesses 58′ have peripherally extending ramps 78, extending to the adjacent pair of recesses 58, and when the outer cap housing 24 is rotated, the pins initially ride up these ramps 78, and force the inner body member 34 to the rear, compressing the wave washers 36 to a further degree. In the meantime, the teeth 30 sliding behind the outwardly extending lugs 18, in the space 79 maintain the outer housing 24 at a fixed axial position relative to the mating connector 12. Accordingly, the inner body member 34 is forced to the rear, compressing the springs 36. Finally, when the pins 52 reach the next adjacent recesses 58, the pins drop into these recesses, with a click, locking or detenting the cap in place on the connector. In the course of this detenting action, the inner body member 34 moves slightly to the left, as shown in FIG. 1, so that the pins 52 and 54 seat in the locking or detenting recesses 58. Incidentally, in FIG. 6, when the cap is disassembled, the pins are detented in the recesses 58′ at the top and bottom of FIG. 6. As stated above, on assembly with the receptacle, as the outer housing 24 is rotated, the pins 52 and 54 ride up the ramps 78, in the direction indicated by the arrows in FIG. 6, until they seat in the recesses 58 at the left and right-hand side of FIG. 6, and this locking or detenting action may be recognized by an audible click. When pins 52 and 54 enter recesses 58, seal 34 re-engages and seals barrel 16.

It is noted again that pins 52 and 54 of housing 24 orient inner body 34 to outer body 24 by seating in recesses 58′. This guarantees proper relationship between teeth 30, recess 62 and teeth 18 of connector 12.

In the mated and locked orientation, housing 24 cannot be rotated clockwise more than 90° (this specific case only) because pins 52 and 54 are stopped by surfaces 81. Rotation in a counterclockwise direction is prevented by surfaces 83 (end of ramps 78). This situation provides positive locking of the cap 22 onto the connector 12.

To remove the cap substantial force must be applied to housing 24 in a counterclockwise direction. Contact between pins 52 and 54 and surfaces 83 is an angular one providing a cam action to move part 34 rearward, compressing springs 36, and causing pins 52 and 54 to again ride against ramp 78.

The outer body 24 can be rotated counterclockwise until pins 52 and 54 come in contact with surfaces 85. This now aligns the teeth 30 with spaces between teeth 18 on barrel 16 and allows pins 52 and 54 to move into recesses 58' and the cap 22 to be removed from the connector.

The exploded view of FIG. 5 is somewhat redundant, relative to the other figures of the drawings, but is useful in visualizing the over-all mode of construction of the cap. The components are assembled from the larger diameter rear end 26 of the housing 24 and are then locked in place with the spring locking washer or ring 42.

In conclusion, it is to be understood that the foregoing detailed description and the accompanying drawings relate to one preferred embodiment of the invention and is merely illustrative of the invention. Other protective EMI and environmentally sealing caps may be employed using similar principles, but accommodating connectors of other configurations. Further, by way of example and not of limitation, the detenting at successive points upon relative motion of the inner body and the outer housing may be accomplished using leaf spring members, rather than pins; and the resilient action of the wave springs may be accomplished using a flat coil spring, or compressed resilient material, instead of the wave springs. It is further noted that the detenting recesses and intermediate ramps or camming surfaces could be formed on the inner surface of the outer housing, with mating pins or cam following surfaces on the inner body member, to provide the functions described hereinabove. Other numbers of pins and mating recesses could be used with a corresponding difference in angular rotation of the parts. Other similar minor substitutions of one mechanical arrangement for another may also be accomplished, while performing the same functions as disclosed herein. Accordingly, it is to be understood that the present invention is not limited to the precise construction shown in the drawings and described hereinabove.

What is claimed is:

1. An EMI and environmentally protected cap assembly for protecting exposed connectors having a cylindrical surface with radially extending coupling lugs to which a mating connector is not coupled, said cap assembly comprising:

a hollow generally cylindrical outer housing having a passageway extending through the length thereof, said housing having a large diameter rear end and a reduced diameter front end, having an inwardly directed flange at the larger rear end thereof, and a plurality of inwardly directed teeth means at the small end thereof for passing between the coupling lugs of the connector and for locking behind the coupling lugs of said connector when the housing is rotated;

an inner, generally cylindrical, substantially cup-shaped, hollow body member rotatably mounted within said outer housing, said body member including recesses for receiving and engaging said lugs to hold said inner body member at a substantially fixed angular orientation with respect to the connector as the housing is rotated, and with the end of the connector extending into said inner body member;

mechanical detent means for selectively holding said inner body at either of two fixed orientations with respect to said outer housing, following rotation of said housing to lock said teeth with one of said fixed orientations being with the cap assembly separated from the connector, and the other of said fixed orientations behind the lugs of the connector;

resilient sheet means for sealing the end of the connector mounted within said inner body member toward the closed end of said cup shaped inner body member;

spring means mounted in said housing near the larger end thereof for mechanically biasing said inner body member forward toward the smaller end of said housing;

metal plate means for closing the larger end of said housing; and annular coil spring means mounted in an inner circumferential groove in said inner body member to bear on the outer surface of the connector, to block electromagnetic radiation between the connector and said inner body member.

2. An EMI and environmentally protected cap assembly as defined in claim 1 wherein said detent means includes at least one inwardly directed pin secured to said housing, and corresponding recess means on said inner body member for engaging said pin.

3. An EMI and environmentally protected cap assembly defined in claim 2 wherein said detent means includes a pair of pins.

4. An EMI and environmentally protected cap assembly as defined in claim 2 wherein two recess means are provided for each pin to thereby provide one detented angular orientation of said housing at which the cap assembly is locked to the connector and one detented angular orientation at which the housing and the inner body member are oriented to receive the mating connector.

5. An EMI and environmentally protected cap assembly as defined in claim 1 wherein said spring means includes a plurality of springy wave washers spaced apart by at least one flat washer.

6. An EMI and environmentally protected cap assembly as defined in claim 1 wherein means are provided for shifting the position of said inner body member axially away from said connector against the force of said spring means, as said outer housing is rotated.

7. An EMI and environmentally protected cap assembly as defined in claim 6 wherein said means of claim 6 includes a ramp surface on said inner body member.

8. An EMI and environmentally protected cap assembly as defined in claim 1 wherein the coupling lugs on the connector have a non-uniform peripheral configuration, and the interfitting teeth on said housing and recesses on said inner body member have a corresponding configuration requiring alignment of the cap assembly at a predetermined orientation for mounting the cap assembly to the connector.

9. An EMI and environmentally protected cap assembly for protecting exposed connectors having a cylindrical surface with radially extending coupling lugs to which a mating connector is not coupled, said cap assembly comprising:

a hollow generally cylindrical outer housing having a plurality of inwardly directed teeth means at one end thereof for passing between the coupling lugs of the connector and for locking behind the coupling lugs of said connector when the housing is rotated;

an inner, generally cylindrical, hollow body member rotatably mounted within said outer housing, said body member including recesses for receiving and engaging said lugs to hold said inner body member at a substantially fixed angular orientation with respect to the connector as the housing is rotated, and with the end of the connector extending into said inner body member; and mechanical detent means for holding said inner body at a fixed orientation with respect to said outer housing, following rotation of said housing to lock said teeth behind the lugs of the connector; and means included in said cap assembly for environmentally sealing said connector, and further means included in said cap assembly for sealing said connector against electromagnetic radiation.

10. An EMI and environmentally protected cap assembly as defined in claim 9 wherein said environmental sealing means includes a sheet of resilient material mounted to engage the open end of said connector when said cap assembly is locked to the connector.

11. An EMI and environmentally protected cap assembly as defined in claim 9 wherein said electromagnetic radiation sealing means includes an annular coil spring between said inner body member and said outer housing and conductively engaging said member and housing.

12. An EMI and environmentally protected cap assembly as defined in claim 9 wherein said detent means includes at least one inwardly directed pin secured to said housing, and corresponding recess means on said inner body for engaging said pin.

13. An EMI and environmentally protected cap assembly as defined in claim 12 wherein said detent means includes a pair of pins.

14. An EMI and environmentally protected cap assembly as defined in claim 12 wherein two recess means are provided for each pin to thereby provide one detented angular orientation of said housing at which the cap assembly is locked to the connector and one detented angular orientation at which the housing and the inner body member are oriented to receive the mating connector.

15. An EMI and environmentally protected cap assembly as defined in claim 9 wherein resilient means are provided for mechanically biasing said inner body member toward said one end of said outer housing.

16. An EMI and environmentally protected cap assembly as defined in claim 15 wherein said resilient means includes a plurality of springy wave washers spaced apart by at least one flat washer.

17. An EMI and environmentally protected cap assembly for protecting exposed connectors having a cylindrical surface with radially extending coupling lugs to which a mating connector is not coupled, said cap assembly comprising:

a hollow generally cylindrical outer housing having a passageway extending through the length thereof, said housing having a large diameter rear end and a reduced diameter front end, and a plurality of inwardly directed teeth means at the small end thereof for passing between the coupling lugs of the connector and for locking behind the coupling lugs of said connector when said housing is rotated;

an inner, generally cylindrical, hollow body member rotatably mounted within said outer housing, said body member including means for engaging said lugs to hold said inner body member at a substantially fixed angular orientation with respect to the connector as the housing is rotated;

mechanical detent means for selectively holding said inner body at either of two fixed orientations with respect to said outer housing, following rotation of said housing to lock said teeth with one of said fixed orientations being with the cup assembly separated from the connector, and the other of said fixed orientations behind the lugs of the connector;

means for environmentally sealing the end of the connector;

spring means for mechanically biasing said inner body member forward toward the smaller end of said housing; and annular coil spring means mounted in said cup assembly to block electromagnetic radiation between the connector and said inner body member.

18. An EMI and environmentally protected cap assembly as defined in claim 17 wherein said spring means includes a plurality of springy wave washers spaced apart by at least one flat washer.

19. An EMI and environmentally protected cap assembly as defined in claim 17 wherein means are provided for shifting the position of said inner body member axially away from said connector against the force of said spring means, as said outer housing is rotated.

20. An EMI and environmentally protected cap assembly as defined in claim 19 wherein said means of claim 19 includes a ramp surface on said inner body member.

* * * * *